United States Patent [19]

Pauliukonis

[11] Patent Number: 4,457,210

[45] Date of Patent: Jul. 3, 1984

[54] ROTARY ACTUATOR WITH ENERGY CONSERVATION

[76] Inventor: Richard S. Pauliukonis, 6660 Greenbriar Dr., Cleveland, Ohio 44130

[21] Appl. No.: 423,140

[22] Filed: Sep. 24, 1982

[51] Int. Cl.[3] ..... F15B 11/15; F15B 15/17

[52] U.S. Cl. ..... 91/355; 91/399; 91/416; 91/459; 92/136

[58] Field of Search ..... 91/399, 416, 355, 356; 92/134

[56] References Cited

U.S. PATENT DOCUMENTS

| | | | |
|---|---|---|---|
| 1,056,600 | 3/1913 | Spohrer | 91/399 |
| 2,746,425 | 5/1956 | Scholer | 91/416 |
| 3,023,739 | 3/1962 | Dickson, Jr. et al. | 91/355 |
| 4,226,167 | 10/1980 | Lew | 92/134 |

*Primary Examiner*—Paul E. Maslousky
*Attorney, Agent, or Firm*—R. S. Pauliukonis

[57] ABSTRACT

An energy conserving air motor with rotary actuation includes a pair of cooperating different diameter pistons coaxially arranged and connected rigidly to one another by a central connecting member provided with spur gear section adaptable of receiving a meshing pinion assembled inside an elongated housing provided with a diffential diameter bore passing therethrough and adaptable of receiving inside a larger diameter section which is blind a larger piston while smaller diameter section which is provided with fluid supply and exhaust port means receives smaller diameter piston while said pinion entering said housing perpendicularly substantially central to the housing ends so as to rotate therein when pistons move linearly inside bore between a first normally atmospheric and a second energized positions in response to the working fluid pressure supplied via fluid supply and exhaust port means by way of a 3-way solenoid or pilot operated directional valve so as to allow energization of the small diameter piston, initially atmospheric, with an end force large enough to shift piston assembly into the second energized position at which time working fluid enters backside of the larger piston via internal pilot porting provided therebetween to exert a much larger end force than that prevailing over the small piston, automatically returning piston assembly into the first original position for an eventual exhaust of the working fluid via 3-way valve and cycle repetition saving energy.

7 Claims, 3 Drawing Figures

ROTARY ACTUATOR WITH ENERGY CONSERVATION

This invention relates to rotary actuators in general and to an energy conserving air motor capable of converting linear motion into a rotary motion in particular. Most air motors operate by a supply of the working fluid to admit pressure into the first actuating piston end while the second actuating piston end is to exhaust with movement of the piston assembly between end positions effected by the reciprocating pistons requiring for each stroke piston assembly makes a new supply of the working fluid to each actuating piston, consuming substantial amounts of the workig fluid, be it compressed air or other gases under pressure, amounting to rather large costs in operational fluid let alone controls which must be such that permit simultaneous fluid supply to one end of air motor while the other end thereof is to exhaust compounding the cost at the expense of inferior relability such air motors sustain due to design complexities found in conventional rotary actuators and similar devices of this general type. The design and the operation of air motors in existance need improvements, and there is no simple energy conserving air motor listed in patent literature or any other source.

Therefore, a principle object of the present invention is to provide a simple air motor design for use with pressurized air or gas.

Specifically, a main object of the present invention is to provide an energy conserving rotary actuator wherein the design incorporates means for air utilization twice before exhausting which means that the pistons incorporated therein are subjected to a double action substantially by a single slug of air entering and leaving the same port at the end of each cycle after performing a forward stroking of a piston assembly linearly inside a housing bore first before returning and in effect performing a backward stroke automatically for a return to a first piston atmospheric position by the same slug of air, facilitating great energy conservation.

It is furthermore an object of the present invention to adapt various control techniques to the operation of energy conserving rotary actuator which translates linear motion into a rotary motion at considerably less cost.

In addition, a further object of the present invention is to employ a pair of cooperating pistons coaxially arranged and connected rigidly to one another by a mutually interconnecting member provided with rack plus associated pinion in an assembly of an elongated housing provided with a differential diameter bore passing therethrough of which a smaller diameter end slidably receiving a smaller diameter piston includes a port for the supply and exhaust of the working fluid under pressure to urge piston position change by exerting an end force over the small piston large enough to shift the whole assembly into the second energized position until the working fluid penetrates behind the larger diameter piston received slidably inside a larger diameter end of the differential diameter bore to exert proportionally larger end force than that developed over the smaller diameter piston facilitating an automatic return of the assembly into the first original atmospheric position practically at no cost for the working fluid and indeed performing not only linear motion but also rotary motion by way of meshing pinion twice. Such fluid penetration from the small diameter bore end to the larger diameter bore end proceeds by way of a pilot port incorporated into the piston interconnecting member so as to permit a variety of restriction to flow therebetween for control of speed of operation.

These and other objects and advantages of the invention will become more fully apparent to those skilled in the art from the following description of one specific embodiment thereof, in conjunction with the accompanying drawings.

IN THE DRAWINGS

Figure 1:
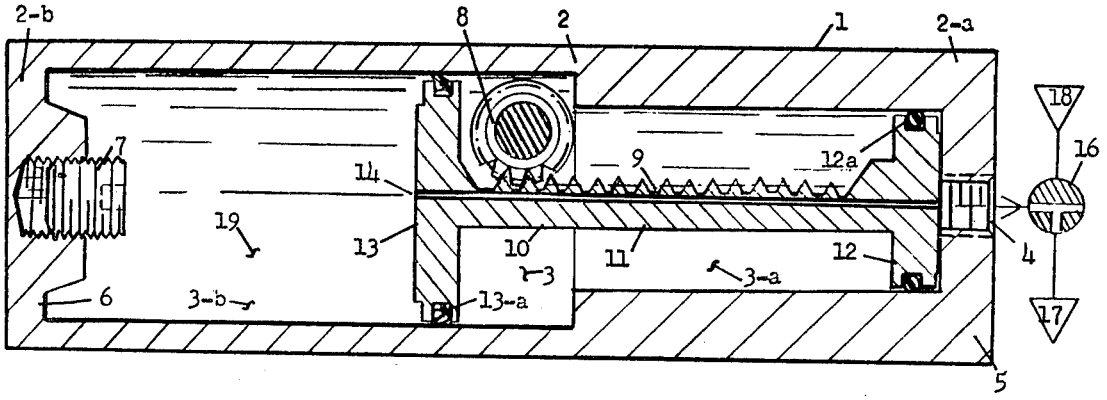
FIG. 1 is a cross-sectional view through a rotary actuator of the invention, with a schematic showing an operating 3-way valve.

Shown in FIG. 1 in cross-section is an energy conserving rotary actuator 1 of a design that includes an elongated housing 2 provided with a differential diameter bore 3 passing therethrough between housing ends of which a first housing end **2-*a* at the end of a smaller diameter bore portion 3-*a* is closed and provided with a fluid port 4 in the center of an end closure 5 while a second housing end 2-*b* at the end of a larger diameter bore portion 3-*b* is closed by an end closure 6 provided with a stroke adjuster 7 of simple threaded stud configuration spaced central thereto in a position selected when determining the arc of rotation of a pinion 8 that enters housing 2 perpendicularly to mesh with an associated spur gear often called rack 9 of a piston assembly 10**.

Figure 2:
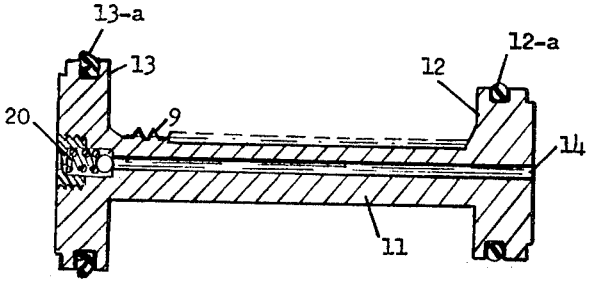
FIG. 2 is a cross-section of a piston assembly which includes a check valve inside pilot port feeding working fluid from small to large piston side.

Piston assembly 10 of FIG. 1. or FIG. 2 includes a pair of cooperating different diameter pistons coaxially arranged and connected rigidly to one another by a central connecting rod 11 provided with spur gear 9 section in mesh with pinion 8 when assembled inside housing bore 3 so as to have a first smaller diameter piston 12 provided with a seal **12-*a* enter the smaller diameter bore portion 3-*a* while a second larger diameter piston 13 provided with a peripheral seal 13-*a* slidably enters the larger diameter bore portion 3-*b*, and also a pilot port 14** interconnecting small and large pistons for fluid communication therebetween.

Referring to FIG. 1 which shows the actuator in a first de-energized position with 3-way valve 16 open to atmosphere as indicated by arrow 17 while supply line with arrow 18 is disconnected, small piston 12 is in a first position adjacent end closure 5 which limits exhaust stroke and permits discharge of the working fluid from a cavity 19 of large diameter portion **3-*b* behind piston 13 when the working fluid action over larger diameter piston 13 exerted an end force larger than that exerted over smaller diameter piston 12 urging an automatic return of piston assembly 10 from a second piston energized position (not shown) to a first atmospheric position of FIG. 1 and unloading of cavity 19 via pilot port 14 and port 4 of housing end closure 5**.

Conversely, when valve 16 is turned to supply working fluid into port 4 while disconnecting exhaust 17, small piston 12 becomes energized by the working fluid that exerts an end force large enough to shift piston assembly 10 into the cavity 19 formerly atmospheric until piston 13 abuts stroke adjusted 7 at which time working fluid penetrates pilot port 14 to exist into the cavity 19 and exert an opposite larger end force than the small piston 12 experienced forcing return of piston assembly 10 into the first position even before valve 16 becomes opened to atmosphere and thereafter until cycle becomes repeated by opening and closing control valve 16. In turn, a single slug of air that enters small diameter bore end 3-*a* via port 4 not only shifts piston assembly 10 from the first original atmospheric position into the second piston energized position but also returns piston assembly into the orginal position greatly conserving costly air, in a double acting fashion normally requiring two slugs of air instead, while simultaneously rotating pinion 8 into two different directions on an arc controllable by the stroke adjuster 7.

Obviously, stroke adjuster 7 may be eliminated in systems that need no adjustment without effecting invention. It is also obvious that the diameters of the large and small pistons can be selected so as to permit force balanced operation when the diametral piston ratio is adjusted to suit operating requirements. This ratio follows a known simple principle of pressure action over different piston diameters in accordance with BOULE's law where $A_1P_1V_1=A_2P_2V_2$. If work must be performed by the pinion of equal magnitude in both directions, large diameter piston must be at least twice the area of the small diameter piston when compensation is made for volumetric change from $V_1$ to $V_2$ mathematically with account for pressure changes from $P_1$ to $P_2$. In practice it was established that for limited stroke this ration is approximately 1.5:1 of diameters of large versus small pistons. To make a generalization it is rather difficult due to many factors, such as sizes, pressures of the working fluid at start and forces pinion must develop in terms of torque.

To accomodate variations, piston pilot port was subjected to various modifications. FIG. 2 shows a first modification wherein a restriction to the flow of the working fluid was provided by a check valve 20 seured inside large piston 13 so as to insure a delayed transfer of the working fluid from the first small piston end to the second larger piston end until piston assembly assumes second position first at which time the working fluid pressure cracks the check valve 20 permitting fluid discharge into the cavity 19 for automatic return of piston assembly 10 into the first atmospheric position. This provision was found adequate in small diameter systems.

Figure 3:
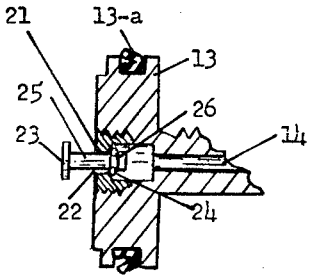
FIG. 3 is a section of large piston provided with physically actuated pin for flow control from small to large piston side at the end of stroke of piston assembly.

However, best results materialized by a modification of FIG. 3 which shows a section of a large piston 13 with pilot port 14 including a pin operated flow control provision 21 wherein the working fluid entering pilot port 14 maintains fluid supply port 22 to cavity 19 always closed until the piston assembly is shifted to the second energized position at which time pin head 23 becomes physically moved by the contact with either stroke adjuster 7 or end closure 6 to permit supply of the working fluid into the cavity 19 urging piston return to the first atmospheric position and until a new slug of air becomes introduced into the small piston end 12 simultaneously closing port 22 by a seal 24 of a pin 25. The flow control provision 21 is nothing else but a simple insert having a port 22 adaptable of receiving pin 25 subassembled thereto by locating seal 24 into an appropriate groove 26 after inserting pin 25 through the port 22 first so as to allow free floating of the pin assembly therein until the working fluid pressure enters port 4 and pilot port 14 forcing pin 25 into the port 22 closed position by the fluid pressure action over seal 24 of pin 25, and vice-versa.

Experiments with various design options relative to the control of pilot port 14 indicated that most applications of air motors can be handled by the design of FIG. 1 wherein pilot port 14 is unobstructed, except for small rotary actuators which operate better with a check valve 20 of FIG. 2 while the design of FIG. 3 can be used universally in applications that require specific motion with a built-in delay action.

Obviously, piston assembly 10 be it of FIGS. 1, 2 or 3 can be placed into the bore 3 through the larger diameter bore end 2-*b* prior to placing and securing end closure 6 followed by an insertion of the perpendicularly entering pinion 8 for meshing rack 9 in final assembly of the unit. Or the housing 2 may be split in the center adjacent a diametral step between smaller and larger diameter bore portions 3-*a* and 3-*b* respectively in order to complete assembly of the unit with piston assembly 10 inside the housing 2. Likewise, it has been experimentally proven that the unit can be operated by a 3-way solenoid valve 16 incorporated into the port 4 so as to have valve 16 timer operated at preselected cycle to suit requirements, or it may be pilot operated (not shown) by a tripper of sorts to insure that the working fluid is delivered by way of valve 16 from point 18 identified by arrow to the air motor for unit operation, and exhausted by way of valve 16 into the atmosphere via conduit 17 shown in FIG. 1, at the end of the cycle resulting in conservation of energy up to 50% of that used with conventional air motors requiring two slugs of air to shift the piston assembly from the first atmospheric position FIG. 1 shows to the second energized position (not shown) while rotating the pinion 8 into one direction and also returning from the second energized position by a differential force equivallent to the original forward force with rotation of pinion into the opposite direction unitl piston assembly 10 returns to the first atmospheric position automatically using single slug of air instead, satisfying the objectives of the invention in full.

While the invention has been described in detail for the preferred form shown, it will be understood that modifications may be made without departure from the claimed invention in scope and the spirit. For example, the pinion 8 may be provided with an outwardly extending shaft (not shown) for coupling to a mechanism such as a windshield wiper subject to a rotary reciprocating motion that allows energy conservation and performs a very useful service in systems that are fuel dependent such as trucks and busses most of which employ air motors for this specific purpose, let alone many other uses for this new device requiring minor modifications in applications within this invention. Adding a rod to the piston 13 to protrude end closure 6 so as to act as an energy saving actuator is one of those other uses with minor applicational modifications within the present invention.

What is claimed is:

1. An energy conserving air motor comprising:

an elongated housing with a differential diameter bore passing therethrough between a first larger diameter bore portion entering a first end of said housing partway toward a second end thereof in communication substantially midway therebetween through a diametral step with a second smaller diameter bore portion entering a second end of said housing partway toward a first end thereof terminating with said diametral step, said bore including a first end closure means in said first larger diameter end of said housing, and a second end closure means in said second smaller diameter end of said housing, a fluid port in said second end closure means for supply and exhaust of a working fluid entering and leaving said port, a piston assembly including a pair of cooperating different diameter pistons coaxially arranged and connected rigidly to one another by a central interconnecting member of which a first larger diameter piston and a second smaller diameter piston each of slightly smaller diameter than the diameters of said first larger and second smaller diameter bore portions is slidably received inside said differential diameter bore to move linearly therein sideways between a first normally atmospheric and a second piston energized positions in response to the working lfuid pressure energizing said smaller diameter piston side of said piston assembly first with an end force large enough to shift said piston assembly into said second energized position at which time said working fluid enters a backside of said first larger diameter piston via an internal pilot porting means incorporated into said central interconnecting member for fluid communication between said smaller and larger piston sides exerting an opposite considerably larger end force over said first larger diameter piston side than that exerted over said second smaller diameter piston side forcing an automatic return of said piston assembly from said second energized to said first atmospheric position by the use of the same air twice first before said working fluid is allowed to exhaust facilitating great energy conservation by the fact that said piston assembly is moved first from said atmospheric position, thereby inducing a first single stroke to said piston assembly by a slug of air introduced thereto via said fluid port to energize said second smaller diameter piston resulting in said second energized position and subsequently, at the end of said single stroke, energizing said first larger diameter piston to in fact perform a second stroke by the same air while returning said piston assembly back into said first original position, completing the cycle at practically no cost, and vice-versa.

2. An energy conserving air motor as in claim 1 wherein said housing including a perpendicular side opening entering said first larger diameter bore portion adjacent said diametral step thereof adaptable of receiving a pinion for meshing with a spur gear section incorporated in said central interconnecting member of said piston assembly in an operable relationship so as to rotate therein when said piston assembly is urged to move sideways linearly inside said bore between said first atmospheric and said second piston energized positions facilitating rotation of said pinion into a first direction, and subsequently rotating said pinion into a second opposite to said first direction when said piston assembly becomes moved from said second to said first positions, and vice versa, said pinion adaptable of coupling to a mechanism subject to a rotary reciprocating motion with energy conservation, and vice-versa.

3. An energy conserving air motor as in claim 1 wherein said internal pilot porting means in said central interconnecting member includes a spring loaded check valve means capable of opening when said piston assembly is in said second energized position to allow working fluid flow into said backside of said first larger diameter piston for exerting said opposite considerably larger end force than that originally exerted over said smaller diameter piston to force said automatic return of said piston assembly into said first atmospheric position.

4. An energy conserving air motor as in claim 1 wherein said internal pilot porting means in said central interconnecting member includes an actuating rod movable physically therein for control of working fluid therethrough when said piston assembly is in said second piston energized position to facilitate utilization of the working fluid for double action of said piston assembly inside said differential diameter bore with energy conservation.

5. An energy conserving air motor as in claim 1 wherein said fluid supply and exhaust port means is provided with a 3-way valve which permits supply of the working fluid into said fluid port and also exhaust of the working fluid therefrom at the end of the cycle with double action of said piston assembly inside said differential diameter bore.

6. An energy conserving air motor as in claim 1 wherein said fluid port is provided with a 3-way solenoid valve for control of supply and exhaust of the working fluid.

7. An energy conserving air motor as in claim 1 wherein said fluid supply and exhaust include an automatic control means that permit double action of said piston assembly with energy conservation.

* * * * *